US007721557B1

(12) United States Patent
Stearns

(10) Patent No.: US 7,721,557 B1
(45) Date of Patent: May 25, 2010

(54) METHOD AND SYSTEM FOR PROPANE EXTRACTION AND RECLAMATION

(76) Inventor: John Stearns, 5 Southfield Dr., Sussex, NJ (US) 07461

( * ) Notice: Subject to any disclaimer, the term of this patent is extended or adjusted under 35 U.S.C. 154(b) by 0 days.

(21) Appl. No.: 12/563,003

(22) Filed: Sep. 18, 2009

(51) Int. Cl.
*F17C 3/10* (2006.01)

(52) U.S. Cl. ..... 62/48.2; 62/48.3; 62/614

(58) Field of Classification Search ..... 62/48.2, 62/48.3, 614
See application file for complete search history.

(56) References Cited

U.S. PATENT DOCUMENTS

| | | | | |
|---|---|---|---|---|
| 4,140,073 | A | 2/1979 | Androulakis | |
| 4,333,503 | A | 6/1982 | Stefiuk | |
| 4,727,723 | A * | 3/1988 | Durr | 62/48.2 |
| 5,322,092 | A | 6/1994 | Howeth et al. | |
| 5,431,189 | A | 7/1995 | Jones | |
| 5,685,170 | A | 11/1997 | Sorensen | |
| 5,975,162 | A | 11/1999 | Link, Jr. | |
| 6,089,282 | A | 7/2000 | Spiegelman et al. | |
| 7,434,506 | B2 | 10/2008 | Wilson et al. | |
| 7,448,223 | B2 | 11/2008 | Darling, IV | |
| 7,469,556 | B2 | 12/2008 | Howard | |
| 7,571,763 | B2 | 8/2009 | Schimp | |
| 2006/0076076 | A1 | 4/2006 | Darling, IV | |

OTHER PUBLICATIONS

Blackmer—Maximizing Propane Profits http://www.blackmer.com/MC/EngyBL080501.pdf © 2008, last accessed Apr. 1, 2010.*
Corken—Mobile Evacuation Systems http://www.corken.com/media/brochure/ee_107.pdf, published online Sep. 21, 2007, last accessed Apr. 1, 2010.*
U.S. Appl. No. 12/562,739, filed Sep. 18, 2009, John Stearns.
Blackmer Product Brochure, "Bulletin 501-001: Positive Displacement Pumps and Oil-Free Gas Compressors," pp. 1-16, Oct. 2008.
Corken IDEX Product Brochure, "Liquid Transfer-Vapor Recovery Compressors," pp. 1-40, Sep. 1999.
Needham, J., "Mobile Evacuation Units Gain Popularity," Butane-Propane News, Jan. 2008, pp. 31-32.
Technical Meeting on HCFC Phase-Out, "HCFC Technical Meeting Summary Table," p. 1-5, Apr. 5, 2008.
Blackmer Press Release, "Blackmer LPG Mobile Compressor Units Play Pivotal Role for H&H Gas in Purging Bulk Storage Tanks & Transports," p. 1, Jun. 25, 2008.
Corken IDEX Product Brochure, "LPG-Series: Pumps and Compressors for LPG and NH3 Stationary Applications," pp. 1-24, Feb. 2006.
Hildebrand and Noll, "Propane Emergencies," Third Edition, pp. 255-259, 2007.
Marshall, R., "Focus on: Compressors, Fans & Blowers," Chemical Engineering, p. 55-56, Nov. 2008.

* cited by examiner

*Primary Examiner*—Cheryl J Tyler
*Assistant Examiner*—Justin Loffredo
(74) *Attorney, Agent, or Firm*—Jonathan D. Ball; King & Spalding LLP

(57) ABSTRACT

A method and system are provided for extracting propane vapors from a propane storage tank, and condensing the extracted vapors to form a useable liquid propane product.

1 Claim, 5 Drawing Sheets

METHOD AND SYSTEM FOR PROPANE EXTRACTION AND RECLAMATION

FIELD OF INVENTION

The present invention relates generally to methods and systems for removing gaseous materials from storage vessels. More particularly, the invention relates to methods and systems for removing propane-containing vapors, such as Liquefied Petroleum Gas, from storage tanks and condensing the vapors to form a propane-containing liquid product. The process preferably proceeds entirely in the absence of combustion of LP-gas and thus not only conserves valuable natural resources, but contributes to the environmental quality as well.

BACKGROUND OF THE INVENTION

Liquefied Petroleum Gas (LP-gas or LPG) is a relatively clean-burning hydrocarbon fuel of mixed composition. It is used primarily as a heating fuel in the United States, but also has found widespread utility as a cooking and vehicle fuel and as a refrigerant.

In North America, propane is the major constituent of LP-gas, with minor amounts of propylene, butane, and/or butylene depending on the particular grade. Because these components are gases at ambient temperature and pressure, LP-gas is stored under pressure in steel tanks of varying size depending on their place in the distribution chain.

Retail LP-gas is distributed from bulk plants where it is stored in large spherical or cylindrical tanks, often having capacities from 10,000 up to 30,000 gallons. The bulk plants are supplied by large multi-axel transport trucks carrying 18,000 gallon tanks which have been filled with LP-gas at the refinery or pipeline. From the bulk plant, LP-gas is shipped to retail customers in single-axel delivery truck called bobtails which have varying capacities, but are usually from 1,800 gallons up to 3,500 gallons. The bobtails are used to fill larger stationary tanks called "pigs," installed on the customer's property.

The Liquefied Petroleum Gas Code, also known as "Pamphlet 58," issued by the National Fire Protection Association (NFPA), requires that LP-gas tanks be retrofit to add or modify internal valves by Jul. 1, 2011. To accomplish the retrofit, the propane containers will have to be emptied of both liquid and gaseous propane. Liquid propane, which fills about 80-85% of the volume in a full container, must first be drained. Removal of the remaining propane vapor is conventionally accomplished by a controlled burn-off, which can take several days for a large stationary 30,000 gallon tank.

According to the National Propane Gas Association, there are an estimated 7,000 LP-gas transport trucks, 35,500 bobtails, and 17,000 railcars servicing over 14 million residential LP-gas customers and over one million commercial LPG customers. To bring all of these tanks into compliance with NFPA Pamphlet 58, a massive volume of propane must be burned off if the conventional practice is maintained. Controlled burns are not only time-consuming and potentially dangerous, but wasteful of an increasingly expensive commodity.

It is an object of the present invention to provide a method and system for extracting propane-containing vapors from pressurized storage tanks, without the need for a controlled burn-off, whereby the vapors are condensed to provide a propane-containing liquid.

SUMMARY OF THE INVENTION

In accordance with the foregoing objective and others, the present invention provides a system and method for extracting Liquefied Petroleum Gas (LP-gas) from a tank without combustion. The extracted vapors are condensed to form a useable (and saleable) liquid LP-gas product. The process preferably proceeds entirely in the absence of combustion of propane and thus not only conserves valuable natural resources, but contributes to the environmental quality as well.

In one aspect, a mobile system for propane recovery is provided comprising, in fluid communication, a liquid trap; a vapor line for permitting passage of vapors from a storage tank to the liquid trap; a compressor which receives vapors from said liquid trap, one or more liquid condensing tanks downstream from said compressor, a vapor line for passing effluent from said compressor to said one or more liquid condensing tanks, and a refrigeration unit for cooling said vapor line at a point downstream from said compressor and upstream from said one or more liquid condensing tanks, the system being mounted on a mobile platform. In one embodiment, the refrigeration unit employs as a refrigerant liquefied propane drawn from said one or more liquid condensing tanks and operates by forcing the liquefied propane refrigerant through a thermal expansion valve to convert it into a vapor state. The vaporized propane refrigerant may be recycled by combining it with propane vapors drawn from said storage tank at a point in the vapor line upstream from said liquid trap. In another embodiment, the refrigeration unit may comprise a gas absorption refrigerator. The system may comprising a truck, suitable for driving to the site of a storage tank, and a trailer connected to the truck, the bed of the trailer securely supporting the liquid trap, compressor, one or more liquid condensing tanks, and, if present, the refrigeration unit disposed in thermal contact with the vapor line between the compressor and the liquid condensing tank. An engine for driving the compressor will also typically be secured to the bed of the trailer and may ideally be a propane engine which operates on propane fuel drawn from the received stream of propane.

In another aspect, a method for removing propane from a storage tank is provided comprising: (i) providing a mobile system for propane recovery and positioning said mobile system in proximity to the tank; (ii) establishing fluid communication through a vapor line between the mobile system and the storage tank to be evacuated, typically by connecting the vapor line to a suitable valve on the tank and to a suction manifold feeding the liquid trap; (iii) draining any liquefied propane from said storage tank into a receiving tank, for example by drawing the liquid through the vapor line and into the liquid trap and then pumping liquid from the bottom of the trap into the receiving tank, to achieve an internal volume of liquid in the storage tank of less than about 3% (v/v); (iv) using suction created by a compressor, drawing a stream of propane vapors from the storage tank through the liquid trap, to remove any liquefied propane entrained in the vapor stream, and passing the stream into and through the compressor, which pressurizes and heats said stream of propane vapors; (v) cooling the stream of pressurized propane vapors exiting the compressor by passing the vapors through a refrigeration unit at a point in the vapor line downstream from the compressor and upstream from the one or more liquid condensing tanks; (vi) bubbling the cooled and pressurized stream of propane vapors through liquefied propane in the one or more liquid condensing tanks to condense the propane vapors into a liquid state, about 60% to about 85% (v/v) of the internal volume of said liquid condensing tanks comprising liquefied propane; and (vii) pumping the recovered liquefied propane from the one or more liquid condensing tanks, optionally through a meter, into a receiving tank.

The refrigeration unit may employ liquefied propane drawn from the one or more liquid condensing tanks as a refrigerant. In this embodiment, a stream of liquefied propane, for example, from one or more of the condensing tanks, is forced through a thermal expansion valve (TXV) to reduce the pressure of the liquid and then through an evaporator to convert the liquefied propane refrigerant into cooled vapor. The cooled refrigerant vapor may be passed through coils or the like in a first stage cooler and the vaporized refrigerant exiting the first stage cooler may be recycled by combining it with propane vapors drawn from the storage tank at a point in the vapor line upstream from the liquid trap. The vapor line containing the propane effluent from the compressor may be passed, for example, through coils in an air-to-air cooler having one or more hydraulic fans to provide airflow, the air-to-air cooler being in heat exchange contact with the first stage cooler.

In use, the system is capable of reducing the pressure in an propane storage tank having a capacity of about 30,000-33,000 gallons and an initial pressure of about 110 psi at about 80° F. to a substantially evacuated state in about 5 hours or less under continuous operation. Preferably, substantially all of the propane from the storage tank is recovered, except for any amount combusted in connection with operation of the compressor.

In another implementation, cooling coils may be disposed in the liquid condensing tanks in heat exchange relationship with the liquefied propane in order to keep the temperature of the liquefied propane at a suitably low temperature. The cooling coils may be part of a refrigerant system and may have a refrigerant gas flowing through them. The refrigerant gas may be cooled propane vapors and may come from propane that has been drawn from the liquid condensing tank and passed through a TXV valve and an evaporator. The effluent from the cooling coils may optionally be returned to the liquid trap.

It is yet another object of the invention to provide a method and system for extracting propane from a first propane storage tank comprising the steps of: (i) extracting liquid propane from said propane storage tank, if present, to achieve a final internal volume of liquid propane less than about 3% (v/v); (ii) extracting propane vapors from said propane storage tank by drawing a stream of propane vapor through a liquid trap, for removing liquid propane from said stream of propane vapor, and into a compressor for pressurizing said stream of propane vapor, (iii) bubbling said pressurized stream of propane vapor through a liquid condensing tank for converting said pressurized stream of propane vapor into a liquid state; wherein about 60% to about 85% (v/v) of the internal volume of the liquid condensing tank comprises liquid propane and wherein cooling coils containing circulating refrigerant are disposed within the liquid condensing tank in thermal contact with said liquid propane; to thereby condense said pressurized stream of propane vapor into liquid propane; and (iv) discharging said liquid propane from said liquid condensing tank, optionally through a meter, into a second storage tank.

The methods of the invention may further comprise the steps of (i) purging the emptied first storage tank with air, (ii) modifying the first storage tank, in compliance with NFPA Pamphlet 58, to include internal valves; and (iii) optionally transferring the liquid propane from said second storage tank back into said modified first storage tank.

These and other aspects of the invention will become more apparent from a reading of the following detailed description and accompanying drawings.

DETAILED DESCRIPTION OF THE INVENTION

As used herein, the term "propane" is intended to have its ordinary meaning in the art and includes without limitation the grades of propane known in the art as commercial grade, HD-5, HD-10, R-290 and Special Duty propane. Unless the context implies otherwise, the term "propane" is meant to include gas mixtures composed primarily of propane, such as LP-gas.

Figure 1:
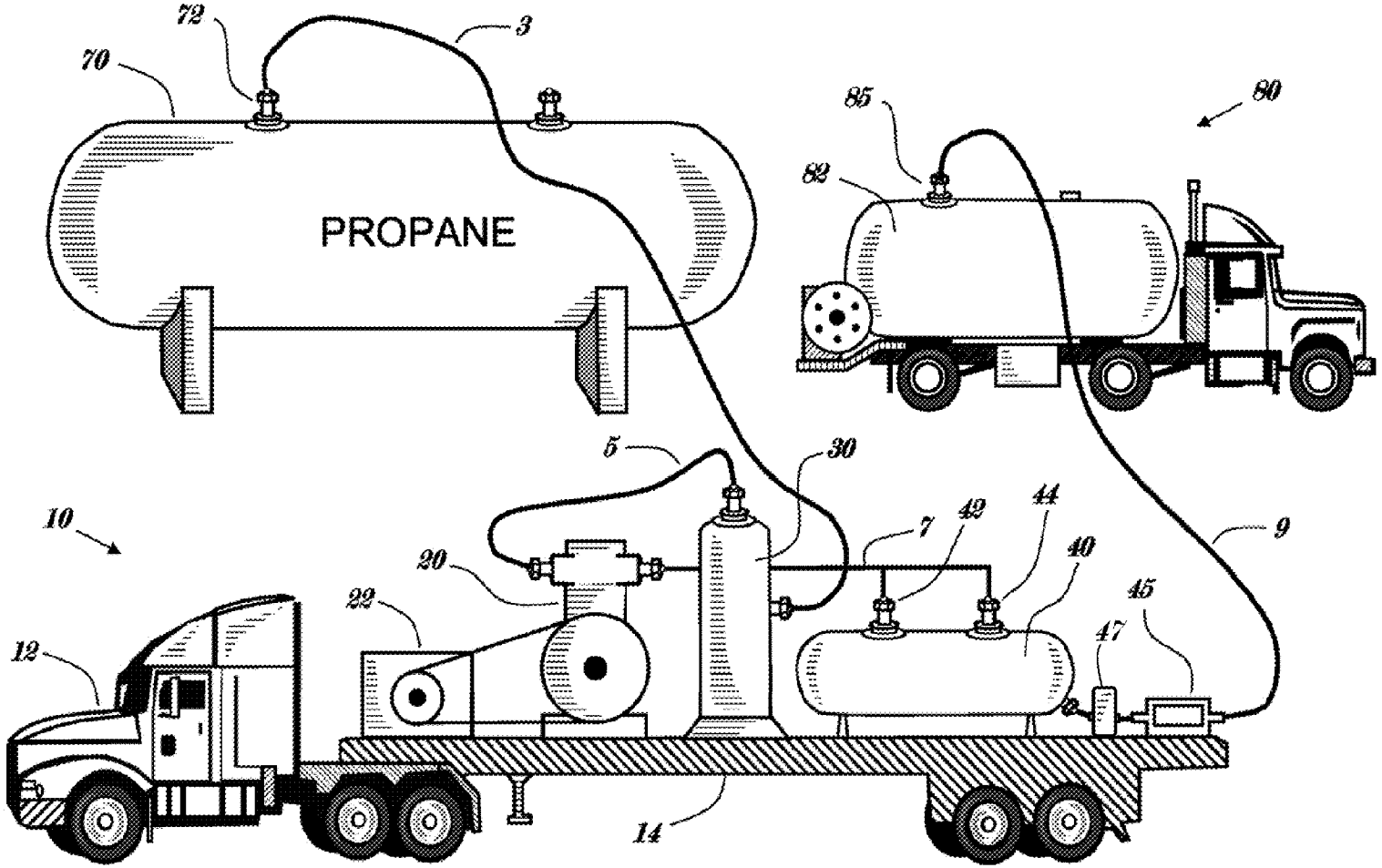
FIG. 1 illustrates one embodiment of the system for extracting and re-condensing propane gas according to the invention, wherein propane vapors are pumped from a stationary LPG tank using the mobile system and the recovered, recondensed liquid propane is metered and charged into a bobtail.
Figure 5:
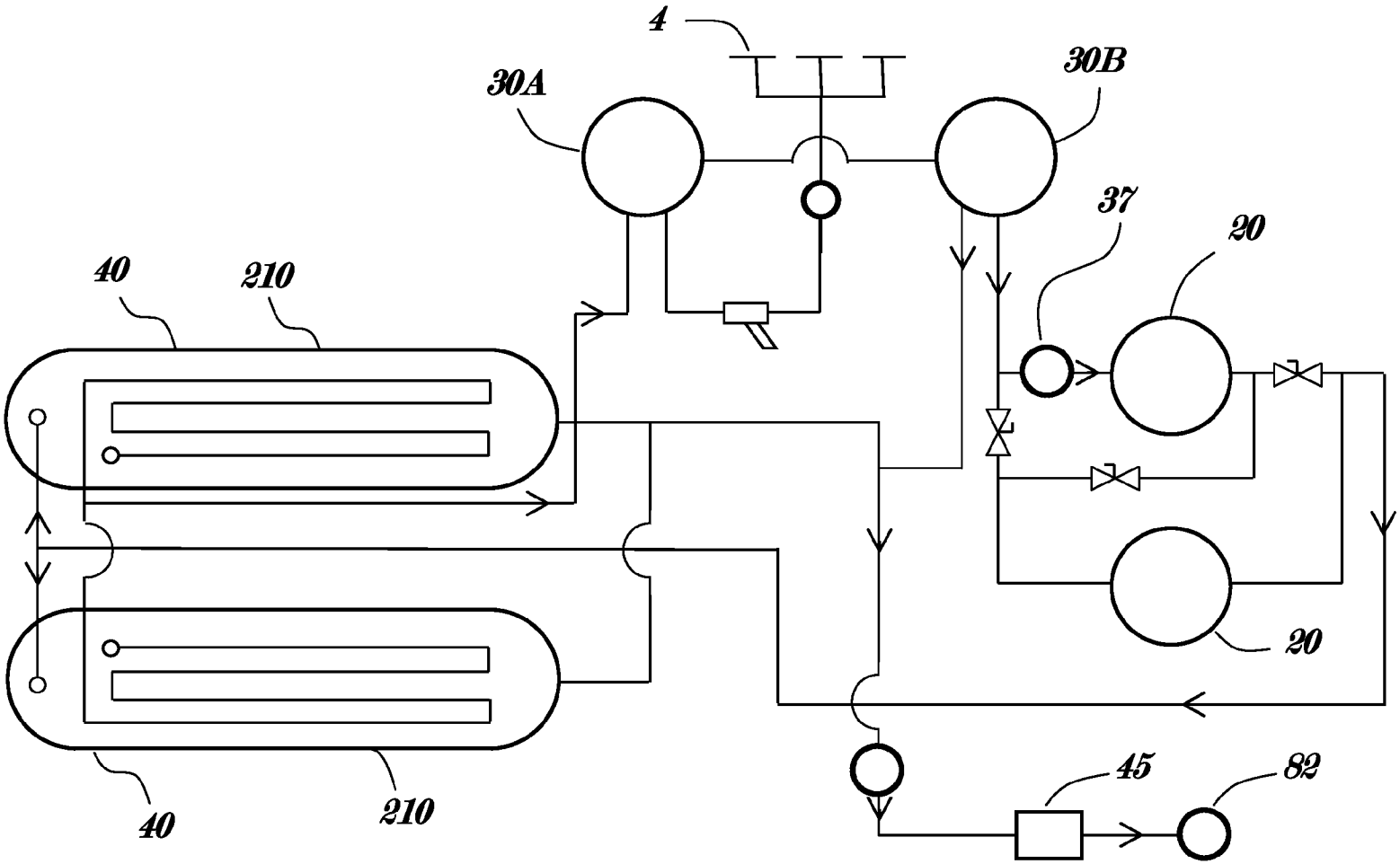
FIG. 5 illustrates one embodiment of the system for extracting and recondensing propane gas according to the invention, wherein propane vapors are drawn into the system from a propane tank through the suction manifold and fed into sequential liquid traps and then into a two-stage vapor compressor which pressurizes the vapor and pumps it into two liquid condensing tanks which are cooled by internal refrigeration coils which use the propane as a refrigerant. The liquid propane is discharged from the liquid condensing tanks into a customer's bobtail or other temporary storage tank. A meter disposed in the line from the condensing tank to the customer's bobtail determines the amount of liquid propane charged into the customer's storage tank.

Referring now to FIG. 1, an example of a mobile propane recovery system 10 is shown comprising a truck 12 and a trailer 14 connected to the truck. In this embodiment, liquid trap 30, vapor compressor 20, liquid condensing tank 40, and drive engine 22 are firmly secured to the bed of trailer 14. In operation, vapor compressor 20 is put in fluid communication with a customer's vapor-containing tank 70 through hose or piping 3 connected to any suitable vapor valve of the tank. The hoses are typically rubber hoses adapted to withstand the operating pressure and may have an internal diameter suitable for achieving a desired flow rate, typically from about 0.75 inches to about 5 inches. Three inch hoses have been found adequate for removing propane vapors from a 30,000 gallon tank in about two hours using a two stage compressor. Hose 3 may feed directly into liquid trap 30 or may feed into suction manifold 4, as shown in FIG. 5, which in turn is in fluid communication with liquid trap 30.

Figure 3:
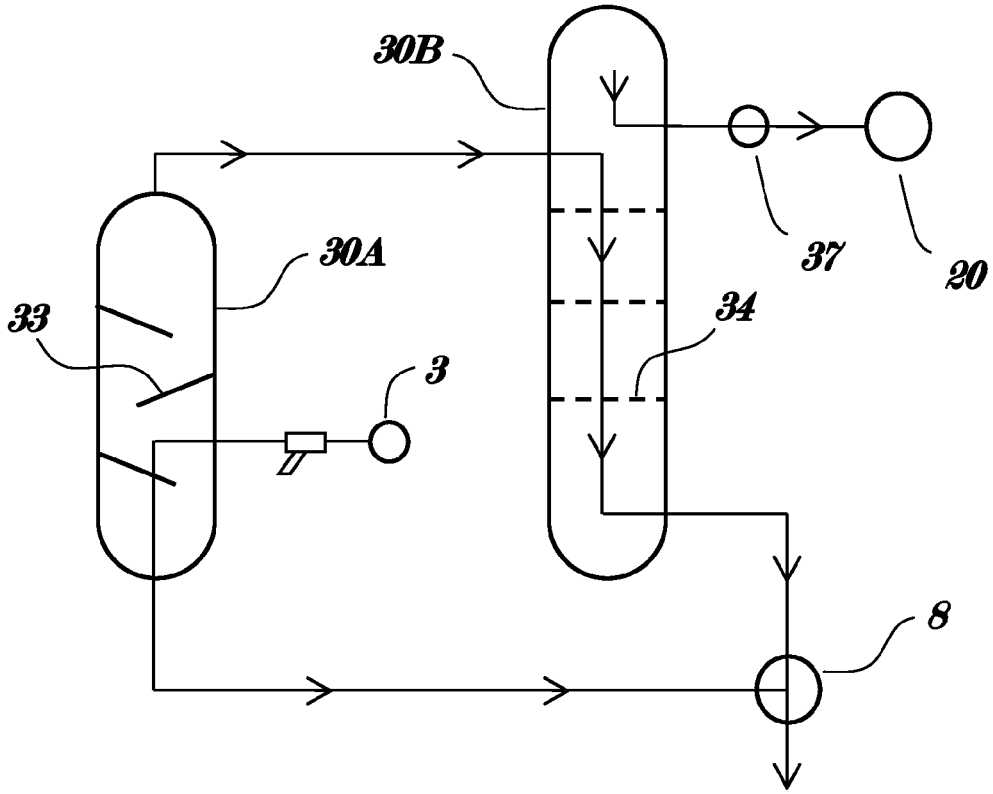
FIG. 3 illustrates one embodiment of the liquid trap component of the system wherein suction from the propane tank to be purged of propane is fed into a first cylinder having a plurality of baffles and vapor is drawn through the top into a second cylinder having a plurality of perforated baffles, wherein liquid from both cylinders is collected from the bottom of each cylinder for optional recovery and reuse, and the vapors are drawn by suction from the compressor from the top of the second cylinder through a line connected to the vapor compressor.

Liquid trap 30 is disposed in the vapor line between the compressor 20 and the customer's tank 70 to remove any liquid propane from the incoming vapor stream in hose 3 and prevent it from entering the compressor. The liquid trap 30 is generally a vertical cylinder having one or more angular internal baffles 33 and/or one or more perforated baffles 34, as illustrated in FIG. 3. It may be desirable to employed two or more liquid traps in sequence as illustrated in FIG. 3 as liquid traps 30A and 30B. The liquid trap may be provided with a sight flow indicator 37 to enable the user to monitor the flow. The liquid collected in the bottom of the trap may be drawn out of the trap, for example, through valve 8 by a liquid pump which may be liquid pump 47 or a dedicated liquid pump (not shown), and stored, discarded, or combined with the effluent from the liquid condensing tanks 40 or another liquid propane line of the system, such as hose 9, either upstream or downstream from meter 45. The vapors are collected from the top of the trap and transmitted, e.g., by hose or pipe 5, into the vapor compressor 20 which is powered by on-board engine 22. The engine 22 may be, for example a V8 drive engine, which may be, without limitation, gasoline or diesel powered, or preferably propane powered. The propane fuel for engine 22 may be taken directly from any suitable line in the system.

There is essentially no constraint on the selection of compressor, aside from its compatibility with the particular substance to be pumped and condensed and its suitability for the capacity of the tank and the desired rate of vapor extraction. The compressor may be without limitation a horizontal or vertical compressor, of single-stage, two-stage, three-stage, or four-stage design, and may be oil-free, non-lubricated, or lubricated. Vertical, oil-free, single-stage compressors covering a range of capacities from 24 to 361 gpm (5.5 to 82 $m^3$/hr) in liquid transfer are available from Corken® (Oklahoma City, Okla.) as Models 91, 291, 491 & 691) and a double-acting single-stage vertical gas compressor capable of capacities from 337 to 757 gpm (76.5 to 171.9 $m^3$/hr) is available from Corken® as Model D891. The compressor may be, for example, a reciprocating compressor, a centrifugal compressor, or the like.

The compressor 20 takes vapor having a first pressure and first temperature at the compressor inlet and produces a vapor stream having a second pressure and second temperature at the outlet of the compressor. The second pressure is typically greater than the first pressure by a factor of 1.5, 2, 3, 4, 5, 6, or even 7 and the second temperature is typically greater than the first temperature.

The pressurized, warm vapors exiting the compressor 20 are transmitted to the liquid condensing tank 40, for example through hose or pipe 7. Liquid condensing tank 40 may be a single tank or may be two or more tanks. Liquid condensing tank 40 may be any size, but a tank of about 150 gallons has been found to fit well on the trailer 14, particularly where two such tanks are used in parallel. In other embodiments, the liquid condensing tank 40 may be up to 2,500 gallons or larger. In a currently preferred implementation, the warm vapors exiting the compressor 20 are fed into two liquid condensing tanks, each having a capacity of 2,500 gallons and each being mounted on bed 14. The liquid condensing tank or tanks are typically kept about 60-80% full with liquid propane. The volume of liquid propane in the tank 40 may be monitored by level control means 43 which may be any suitable device for determining the liquid level, including internal floats and controls or the like.

Figure 4:
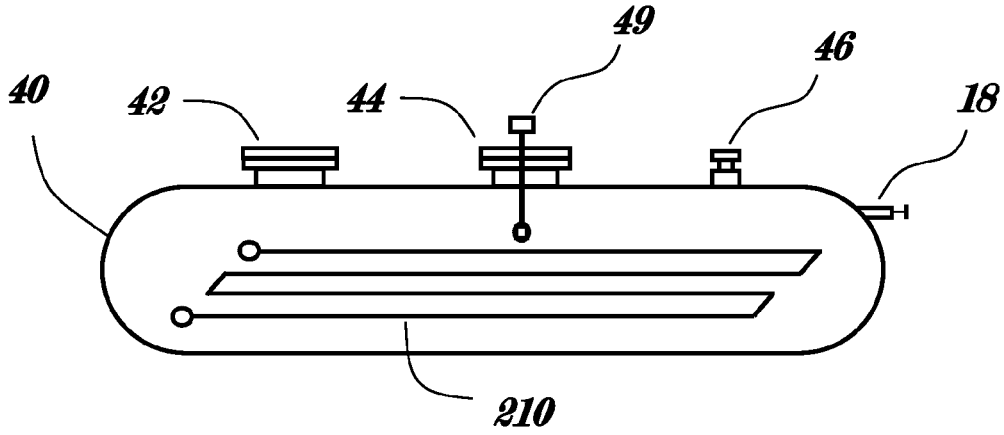
FIG. 4 illustrates one embodiment of a liquid condensing tank according to the invention, wherein the pressurized vapor effluent from the compressor is discharged into the liquid condensing tank, which is about 60-85% full with liquid propane, through a valve and a stem having its end submerged below the surface of the liquid propane such that the vapors from the condenser are bubbled through the liquid propane and recondensed. The liquid propane is cooled to about −40° F. by a refrigeration coil disposed in the tank through which a refrigerant, such as propane, is circulated.

In one embodiment, the liquid propane in the liquid condensing tank 40 is cooled by a refrigerant circulating through internal cooling coils 210 disposed in the internal volume of the tank, as illustrated in FIGS. 4 and 5. The liquid propane in the liquid condensing tank 40 is cooled to a temperature suitable to condense the vapors and maintain the propane in a liquid state. The temperature will, of course, depend on the pressure in the line. The liquid propane in the tank is typically cooled to about 120° F. or colder, or about 100° F. or colder, or about 90° F. or colder, or about 80° F. or colder, or about 70° F. or colder, or about 60° F. or colder, or about 50° F. or colder, or about 40° F. or colder, or about 30° F. or colder, or about 20° F. or colder, or about 10° F. or colder, or about 0° F. or colder, or about −10° F. or colder, or about −20° F. or colder, or about −40° F. or colder.

In one embodiment, a 150 gallon liquid condensing tank is cooled by about 100 feet of internal cooling coils 210. The propane itself may be used as the refrigerant in the cooling coils by continuously drawing an amount of liquid propane from the condensing tank and affecting a phase change (boiling) to the vapor state. Of course, it is not required that the cooling coils be fed from the propane line and any external source of suitable coolant can be used. The phase change may be brought about, for example, by forcing the liquid propane through a thermal expansion valve and then through an evaporator. The vapors exiting the cooling coils may then be recycled by combining them with another vapor line in the system, preferably by returning the vapors to the liquid trap 30A, as shown in FIG. 5.

When all liquid is drained from tank 70, the pressure of propane gas in the tank will be about 110 pounds per square inch (psi) at about 80° F. As propane vapors are withdrawn from the tank through line 3 and compressed by compressor 20, the pressure in tank 70 will fall, eventually reaching about 0 psi in the substantially evacuated state. By "substantially evacuated state" is meant that the amount of propane vapor remaining in the storage tank is less than about 1% of the original amount, preferably less than about 0.5% of the original amount, and more preferably less than about 0.1% of the original amount on a weight basis. With each unit pressure (psi) decrease in tank 70, the temperature of the remaining vapor may increase by about 2° F., such that a temperature increase from start to finish in a 30,000 gallon tank may be about 220° F. This substantial increase in temperature during the pumping cycle could make it progressively more difficult to condense the vapors in the liquid condensing tank 40 and to maintain the liquid condensing tank 40 at a suitably low temperature to continue condensing vapors without the use of an external coolant. Thus, in some embodiments, it may be necessary to pause the pumping in order to maintain the liquid condensing tank 40 at an appropriate temperature to condense propane vapors.

However, it has surprisingly been found that by cooling the propane gas before it enters the condensing tank 40, rather than by solely cooling the liquid in the condensing tank 40, the system is capable of continuous operation and can pump vapor from a tank of about 30,000 gallons without interruption. To accomplish continuous evacuation of vapors from a 30,000 gallon tank, it may be desirable to include a cooling means (e.g., a refrigeration system) 110 in the line between compressor 20 and liquid condensing tank 40 to lower the temperature of the vapor entering the liquid condensing tank (s). Thus, in some embodiments, a suitable means of cooling the line downstream from compressor 20 is employed in place of, or in addition to, the cooling coils 210 disposed in the internal volume of the liquid condensing tank 40.

Figure 2:
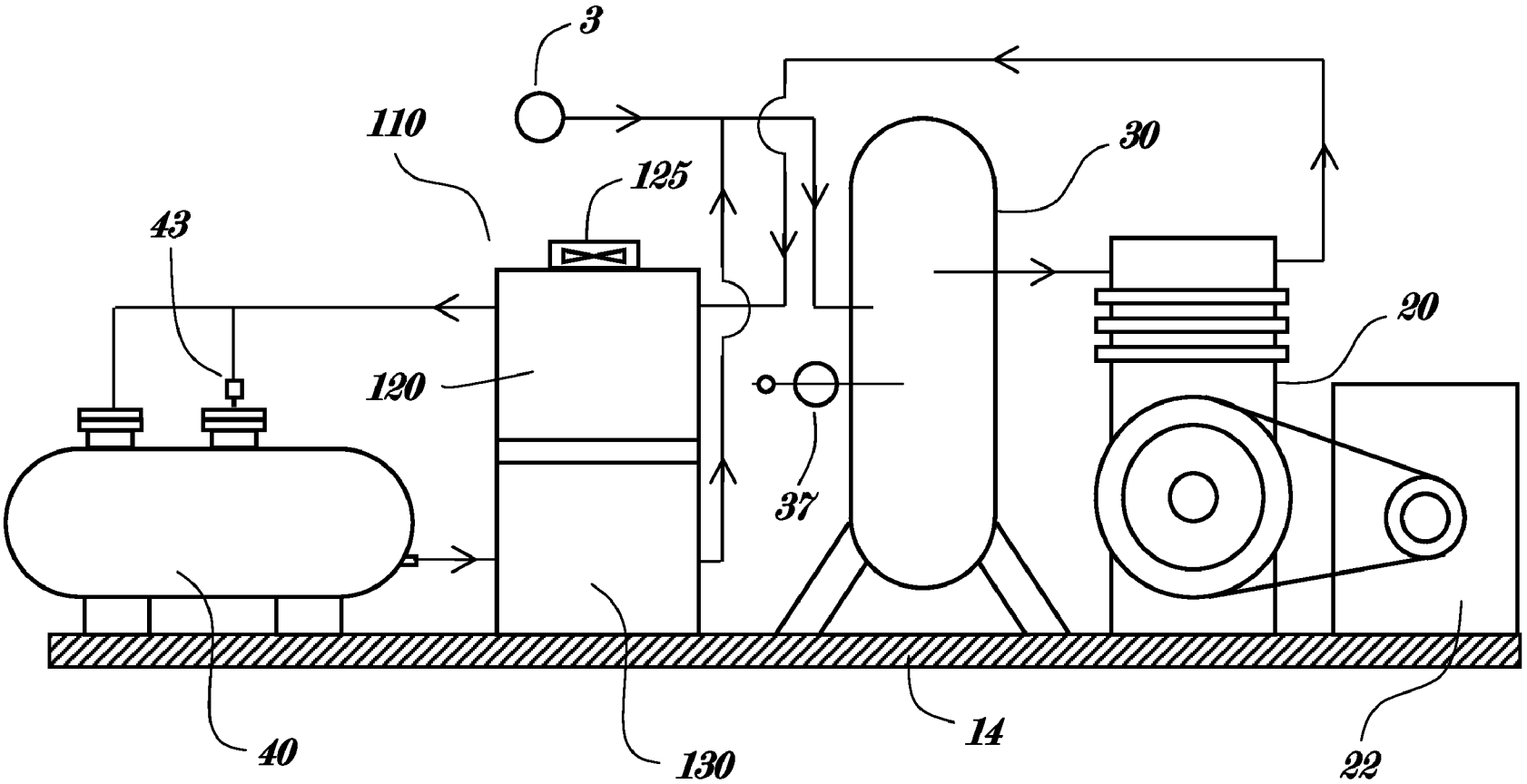
FIG. 2 illustrates one embodiment of the system for extracting and re-condensing propane gas according to the invention, comprising a liquid trap which receives a stream of propane vapor from a suction manifold in fluid communication with the interior of a propane tank, and which feeds propane vapor at a first pressure and first temperature into a vapor compressor driven by a propane-powered V8 drive engine which discharges the propane vapor at a second elevated temperature and pressure into a liquid condensing tank wherein the propane vapor is bubbled through liquid propane and thereby condensed.
Figure 6:
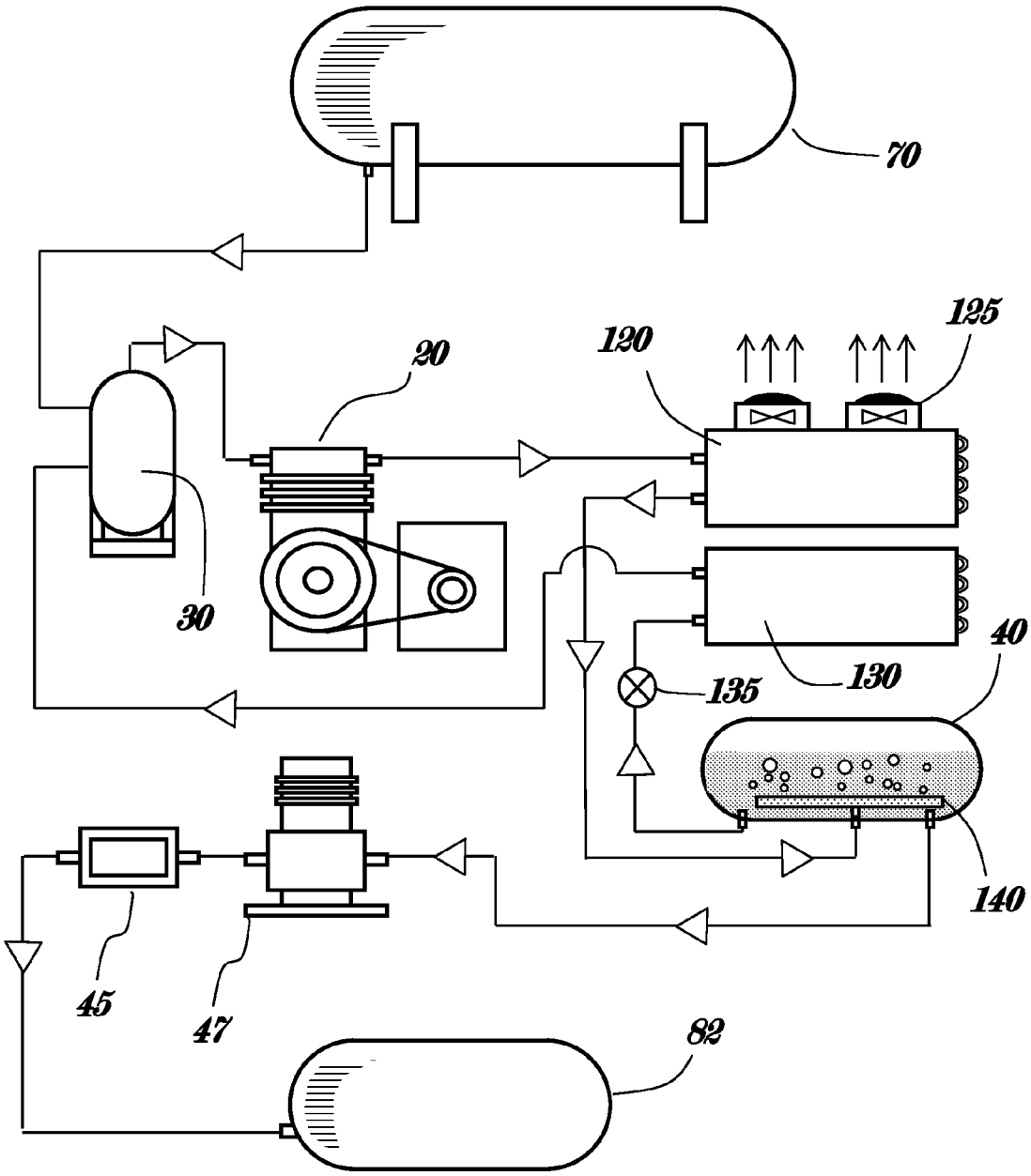
FIG. 6 illustrates one embodiment of the system for extracting and recondensing propane gas according to the invention, wherein propane vapors are drawn into the system from a propane tank, for example through a suction manifold, and fed into one or more liquid traps and then into a two-stage vapor compressor which pressurizes the vapor. The pressurized vapors are then run through a refrigeration unit comprising an air-to-air cooler in heat-exchange relationship with a primary first stage refrigerant cooler. One or more fans drive air flow through the air-to-air cooler to remove heat from the propane vapors flowing through coiled pipes in the air-to-air cooler. The primary first stage refrigerant cooler may utilize condensed propane from the liquid condensing tank as the refrigerant and may recycle the warmed propane vapors back to the liquid trap. The cooled propane vapors existing the refrigeration unit are pumped into one or more liquid condensing tanks. The liquid propane may be discharged from the liquid condensing tanks into a customer's bobtail or other temporary storage tank. A meter disposed in the line from the condensing tank to the customer's bobtail determines the amount of liquid propane charged into the customer's storage tank.

Thus, as shown in FIGS. 2 and 6, a refrigeration unit may be used to cool the propane vapors before entering the liquid condensing tank 40. One suitable variant is shown in FIG. 2, which illustrates the vapor line exiting the compressor and running through refrigeration unit 110. Within the refrigeration unit 110, the vapor line may take the form of a plurality of coils (not shown) to maximize contact with the cooled fluid (e.g., water, air, etc.) in the refrigeration unit. Refrigeration unit 110 may, for example, comprise a chamber 120 enclosing the vapor line and a cooled fluid or gas may be forced through the chamber by one or more hydraulic fans 125. The movement of cooled fluid or gas in chamber 120 draws heat from the propane in the vapor line and pumps it from the system using fans 125. The chamber 120 is preferably an air-to-air cooler. The fluid or gas in the chamber may be cooled, for example, by a primary first stage refrigerant cooler 130 in thermal contact with chamber 120. The primary first stage refrigerant cooler 130 typically operates by forcing a liquefied refrigerant through a thermal expansion valve, shown at 135 in FIG. 6, and through an evaporator (not shown) to produce a cooled refrigerant gas. The refrigerant may advantageously be liquefied propane drawn from liquid condensing tank 40 as illustrated in FIGS. 2 and 6. Alternatively, an external source of refrigerant may be used. When the refrigerant comprises propane drawn from liquid condensing tank 40, the warmed propane gas exiting the primary first stage refrigerant cooler 130 may be recycled, preferably by introducing it back into the system upstream of the compressor 20 and preferably upstream of liquid trap 30.

The pressurized propane vapors exiting the compressor 20 may be cooled, as discussed above, in refrigeration unit 110 and then bubbled through the liquid propane in the liquid condensing tank 40 to further cool and condense the vapors. It has been found to be particularly advantageous to force the compressed propane gas through a stem pipe, shown as 140 in FIG. 6, having a sieve submersed in the liquid propane to reduce the size of the gas bubbles emanating therefrom in order to maximize the contact surface area between the gaseous and liquid propane. In this manner, the rate of condensation may be increased. The use of the liquid condensing tank 40 improves the overall efficiency and rate of propane extraction from tank 70 because the rapid condensation of propane in tank 40 reduces the pressure in the line downstream of the compressor 20 and thus lowers the pressure differential between the inlet and outlet of compressor 20. If the vapor line were instead fed directly into the bobtail tank 82, it would not be possible to control the pressure differential and the rate of extraction of propane from tank 70 would therefore not proceed as rapidly, efficiently or continuously. What is important, in this embodiment, is that the vapors exiting the compressor are cooled by a cooling means, prior to condensation in the liquid condensing tanks, to a temperature sufficiently low such that an entire storage tank of about 30,000 gallons can be continuously evacuated in about 8 hours or less, more typically about 7 hours or less, preferably about 6 hours or less, and ideally about 5 hours or less at ambient temperatures of about 100° F. or less, more typically about 90° F. or less, and more typically still about 80° F. or less. Using a pre-cooling step, a storage tank of about 30,000 gallons was continuously evacuated to about 0 psi in about 4.5 hours using the methods and system described herein.

The liquid propane may be withdrawn from the liquid condensing tank 40 by a hose or pipe 9 and transferred into the customer's storage tank. In FIG. 1, the customer's storage tank is the tank 82 of a bobtail truck 80. The propane is charged into tank 82 through any suitable liquid valve 85. The bobtail tank will typically be about 3,500 gallon and will therefore hold the entire condensate from a large 30,000 LPG tank. A liquid pump 47, such as a centrifugal pump, may used to transfer liquid propane from tank 40 through the meter 45 and into tank 82. A propane meter 45 is preferably disposed between the liquid condensing tank 40 and line 9 to accurately measure the amount of recovered liquid propane delivered to the customer. The meter may be, for example, a positive displacement meter, including those sold by the IDEX corporation under the M™ Series, MS™ Series, and MS™ Series.

The system for extracting and condensing propane gas according to the invention will find use wherever it is necessary or desirable to empty a propane tank. For example, a tank which must be modified in conformance with NFPA Pamphlet 58 will have to be completely emptied of propane before the internal tank modifications can be made. Any amount of liquid propane in the tank will first be drained according to customary practice. The remaining propane vapors and any small amount of liquid propane heel remaining (e.g., up to about 3% by volume) can then be extracted using the methods of the invention. The invention offers complete recovery of the propane from the customer's tank and a return of the recaptured propane to the customer in useable form. Unlike the conventional practice of conducting a controlled burn-off, the method according to the invention allows complete recovery of the propane from the customer's tank in a matter of hours, and does not require regulatory approvals.

The recovered propane may be returned to the customer without cost as part of the service, or may be sold back to the customer at or below the prevailing market value of the particular propane product.

The invention is not limited, of course, to the evacuation of 30,000 gallon storage tanks. It is contemplated that any tank size, including without limitation, about 60,000 gallons, about 45,000 gallons, about 30,000 gallons, about 18,000 gallons, and about 12,000 gallon tanks can be evacuated and the gaseous product recondensed using the methods and apparatus of the invention.

Because the system is self-contained and mobile, the operator can conveniently reach any tank in need of servicing. This is contemplated to be of particular advantage in the case of propane tanks which are at risk of BLEVE (boiling liquid expanding vapor explosion) due to fire and which therefore require rapid response. For example, a propane tanker which has been involved in a highway accident has the potential to undergo BLEVE if the contents are heated by flames beyond the capacity of the relief valves to dissipate pressure. In responding to such situations, fire personnel will typically cool the tanker with a constant stream of water. The ability to rapidly remove the propane from the compromised tank in concert with efforts to cool the tank could prevent a catastrophe. Thus, in one embodiment, the system may be used to rapidly extract propane from a tank at risk of BLEVE due to fire or which has otherwise been compromised. In some circumstances, it may not be possible to connect a vapor line directly to a valve on the tank because, for example, a railcar or transport tank has rolled over and the valves have become inaccessible. It may be possible in such situations to apply a "hot tap" on the shell of the tank by welding a threadolet to the tank and fitting a valve onto the threadolet. The drill of a hot tap machine is then fit through the open valve and used to drill a hole in the tank shell. After the hole is drilled, the coupon is retracted, preferably by pressure from within the tank, and the drill is removed and the valve closed. The vapor line to the propane extraction system may then be connected to this hot tap valve and the contents extracted as discussed above.

It is contemplated that the methods and systems of the present invention will find equal applicability to the extraction and reclamation from storage tanks of gases other than propane, including without limitation, natural gas, butane, ammonia, and the like. The foregoing description of various exemplary embodiments of the invention, therefore apply equally to the case where the gas to be evacuate is ammonia, natural gas, LNG, butane, etc.

The invention having been described by the foregoing description of the preferred embodiments, it will be understood that the skilled artisan may make modifications and variations of these embodiments without departing from the spirit or scope of the invention as set forth in the following claims.

I claim:

1. A method for removing propane from a storage tank comprising: (i) providing a mobile system for propane recovery comprising, in fluid communication, a liquid trap, a first vapor line for permitting passage of vapors from said storage tank to said liquid trap, a two-stage compressor which receives vapors from said liquid trap, one or more liquid condensing tanks downstream from said compressor, a second vapor line for passing effluent from said compressor to said one or more liquid condensing tanks, and a refrigeration unit for cooling said second vapor line at a point downstream from said compressor and upstream from said one or more liquid condensing tanks, the system being mounted on a mobile platform; (ii) establishing fluid communication through a said first vapor line between said mobile system and said storage tank; (iii) draining any liquefied propane from said storage tank into a receiving tank to achieve an internal volume of liquid in said storage tank of less than about 3%; (iv) drawing a stream of propane vapors from said storage tank through said liquid trap, to remove any liquefied propane entrained in said stream, and into said compressor which pressurizes said stream of propane vapors; (v) cooling said stream of pressurized propane vapors with said refrigeration unit; (vi) bubbling said cooled and pressurized stream of propane vapors through liquefied propane in said one or more liquid condensing tanks to condense said propane vapors into a liquid state, about 60% to about 85% of the internal volume of said liquid condensing tanks comprising liquefied propane; and (vii) pumping said liquefied propane from said one or more liquid condensing tanks, optionally through a meter, into said receiving tank; wherein said refrigeration unit employs liquefied propane drawn from said one or more liquid condensing tanks as a refrigerant and operates by forcing said liquefied propane refrigerant through a thermal expansion valve and an evaporator to convert said liquefied propane refrigerant into cooled propane refrigerant vapors which pass through cooling coils in the refrigeration unit and are thereafter recycled by combining with propane vapors drawn from said storage tank at a point in the first vapor line at or upstream from said liquid trap; and wherein said system is capable of reducing the pressure in a storage tank having a capacity of about 30,000 gallons and an initial pressure of about 110 psi at about 80° F. to a substantially evacuated state and recovering substantially all of the propane in about 5 hours or less under continuous operation.

* * * * *